US008913052B2

(12) United States Patent
Gu et al.

(10) Patent No.: US 8,913,052 B2
(45) Date of Patent: Dec. 16, 2014

(54) DISPLAY DEVICE HAVING SECURITY FUNCTION

(75) Inventors: BonSeog Gu, Yongin (KR); Haekwan Seo, Yongin (KR); Taejin Kim, Yongin (KR); Doyoub Kim, Yongin (KR); Myungho Lee, Yongin (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 185 days.

(21) Appl. No.: 13/343,841

(22) Filed: Jan. 5, 2012

(65) Prior Publication Data

US 2012/0188216 A1 Jul. 26, 2012

(30) Foreign Application Priority Data

Jan. 20, 2011 (KR) ..... 10-2011-0005961

(51) Int. Cl.
*G09G 5/00* (2006.01)

(52) U.S. Cl.
CPC ..... *G09G 5/00* (2013.01)
USPC ..... 345/211

(58) Field of Classification Search
CPC ..... G09G 5/00
USPC ..... 345/211
See application file for complete search history.

(56) References Cited

U.S. PATENT DOCUMENTS

| | | | | |
|---|---|---|---|---|
| 6,859,195 | B2 * | 2/2005 | Kodate | 345/92 |
| 8,125,476 | B2 * | 2/2012 | Myung et al. | 345/211 |
| 8,331,069 | B2 * | 12/2012 | Galy et al. | 361/56 |
| 2008/0192042 | A1 * | 8/2008 | Chae et al. | 345/212 |
| 2010/0103203 | A1 * | 4/2010 | Choi | 345/690 |

FOREIGN PATENT DOCUMENTS

| | | | |
|---|---|---|---|
| KR | 10-2006-0012088 | A | 2/2006 |
| KR | 10-2008-0105500 | A | 12/2008 |

* cited by examiner

*Primary Examiner* — Alexander S Beck
*Assistant Examiner* — Neil Wood
(74) *Attorney, Agent, or Firm* — Lee & Morse, P.C.

(57) ABSTRACT

A display device includes a display panel, a module frame having first and second contact pins, and a Printed Circuit Board (PCB) having first and second pads connectable with the first and second contact pins of the module frame, respectively, in a contacting state and disconnectable therewith in a non-contacting state. The first and second contact pins are electrically connected to each other. The PCB includes a circuit block in a non-operational state when the first and second pads are in the non-contacting state with the first and second contact pins of the module frame, respectively.

11 Claims, 8 Drawing Sheets

DISPLAY DEVICE HAVING SECURITY FUNCTION

CROSS-REFERENCE TO RELATED APPLICATIONS

This U.S. non-provisional patent application claims priority under 35 U.S.C. §119 of Korean Patent Application No. 10-2011-0005961, filed on Jan. 20, 2011, the entire contents of which are hereby incorporated by reference.

BACKGROUND

Exemplary types of display devices include Liquid Crystal Display (LCD) devices, which do not have self-emitting characteristic and may include backlights, and organic Electro Luminescence (EL) display devices, which may have self-emitting characteristics. For example, the organic EL display devices may electrically excite a fluorescent organic compound to emit light, and thus may not need a separate light source.

SUMMARY

Embodiments may be realized by providing a display device including a display panel; a module frame including first and second contact pins; and a Printed Circuit Board (PCB) including first and second pads which respectively contact the first and second contact pins of the module frame, wherein: the first and second contact pins are electrically connected to each other, and the PCB includes a circuit block which does not operate when the first and second pads do not contact the first and second contact pins of the module frame.

The circuit block may drive the display panel when the first and second pads contact the first and second contact pins of the module frame. The circuit block of the PCB may include a voltage generator electrically connected to the first pad, and may generate a first voltage. The circuit block of the PCB may further include a driver Integrated Circuit (IC) electrically connected to the second pad, and may operate in response to a security signal inputted through the second pad.

The driver IC may perform control for the display panel to be driven when the security signal inputted through the second pad has a level of the first voltage, and the driver IC may perform control for the display panel not to be driven when the security signal inputted through the second pad does not have the level of the first voltage.

The driver IC may include a driving voltage generator generating first and second power source voltages for driving the display panel; and a security circuit electrically connected to the second pad, and shorting the first and second power source voltages in response to the security signal inputted through the second pad.

The security circuit may include a detector detecting a voltage level of the security signal, and outputting a detection signal; and a transistor connected between the first and second power source voltages, and having a gate connected to the detection signal.

The driver IC may include a voltage generator generating first and second power source voltages for driving the display panel; and a timing controller generating a plurality of control signals for driving the display panel, wherein the timing controller is electrically connected to the second pad, and shorts the first and second power source voltages in response to the security signal inputted through the second pad.

The driver IC may include a timing controller generating first and second control signals for driving the display panel; a source driver driving a plurality of source lines of the display panel in response to the first control signal; a gate driver driving a plurality of gate lines of the display panel in response to the second control signal; a memory storing security setting information; and a security controller electrically connected to the second pad, and storing the security setting information in the memory in response to the security signal inputted through the second pad, wherein the timing controller does not operate when the security setting information stored in the memory has a first value.

The memory may be a One-Time Programmable Read Only Memory (OTP ROM).

The security controller may store security setting information corresponding to a security mode in the memory when the security signal inputted through the second pad does not have the level of the first voltage, and the security controller may store security setting information corresponding to a normal mode in the memory when the security signal inputted through the second pad has the level of the first voltage.

The first and second contact pins may contact the first and second pads, respectively. The PCB may be a Flexible PCB (FPCB).

BRIEF DESCRIPTION OF THE DRAWINGS

The accompanying drawings are included to provide a further understanding and are incorporated in and constitute a part of this specification. Features will become apparent to those of ordinary skill in the art by describing in detail exemplary embodiments with reference to the attached drawings in which.

DETAILED DESCRIPTION

Figure 1A:
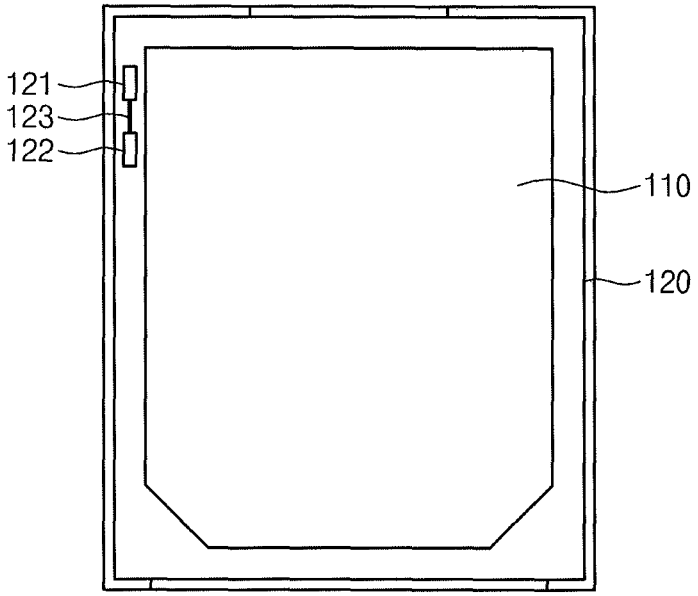
FIGS. 1A and 1B illustrate a rear surface and a side surface of a module frame which configures a display device, according to an exemplary embodiment.

Exemplary embodiments will be described below in more detail with reference to the accompanying drawings; however, they may be embodied in different forms and should not be construed as limited to the embodiments set forth herein. Rather, these embodiments are provided so that this disclosure will be thorough and complete, and will fully convey the scope of the inventive concept to those skilled in the art.

In the figures, the dimensions of layers and regions may be exaggerated for clarity of illustration. It will also be understood that when an element is referred to as being "on" another element, it can be directly on the other element, or intervening elements may also be present. Further, it will also be understood that when an element is referred to as being "between" two elements, it can be the only element between the two elements, or one or more intervening elements may also be present. Like reference numerals refer to like elements throughout FIGS. 1A and 1B are views illustrating a rear surface and side surface of a module frame of a display device according to an exemplary embodiment, respectively.

Figure 1B:
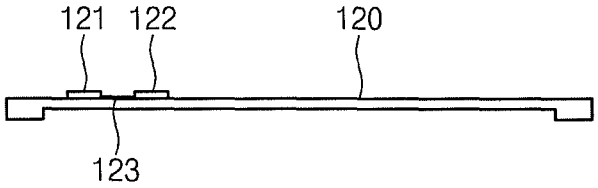

Referring to FIGS. 1A and 1B, first and second contact pins 121 and 122 may be formed at a rear surface of the module frame 120. The first and second contact pins 121 and 122 of the module frame 120 may be arranged such that the first and second contact pins 121 and 122 are separated from each other by a certain distance, e.g., a predetermined distance. The first and second contact pins 121 and 122 may be connected, e.g., across the predetermined separation distance, by an electric interconnection 123. The first and second contact pins 121 and 122 may be formed of a metal material for transferring a signal. An opening 122 may be formed in the module frame 120. A display panel may be disposed in the opening 110. As the display panel disposed in the opening 110, there may be, e.g., one of a Liquid Crystal Display (LCD) panel, an Organic Light Emitting Diode (OLED) panel, an Active Matrix Organic Light Emitting Diode (AMOLED) panel, a Field Emitter Display (FED) panel, and a Plasma Display Panel (PDP). In an exemplary embodiment, the display panel coupled to the opening 110 of the module frame 120 may be an AMOLED panel.

Figure 2A:
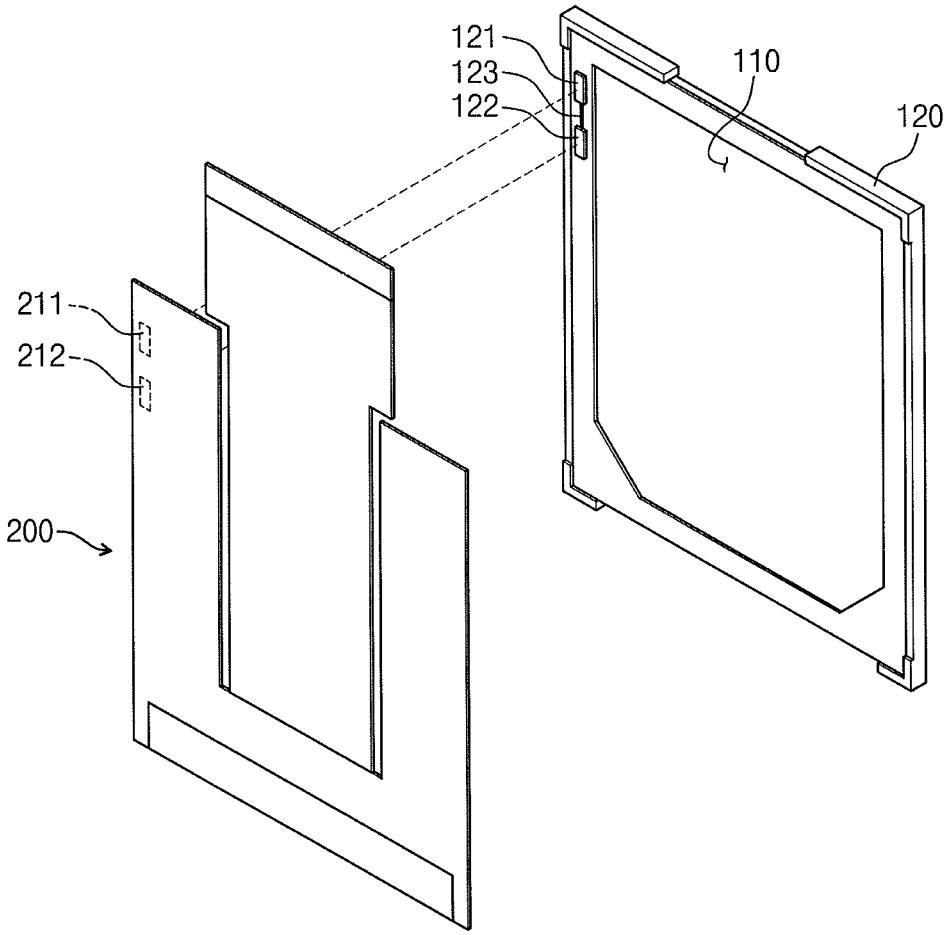
FIGS. 2A to 2C illustrate perspective views of a Printed Circuit Board (PCB) coupled to the module frame of FIG. 1A, according to exemplary embodiments.
Figure 2B:
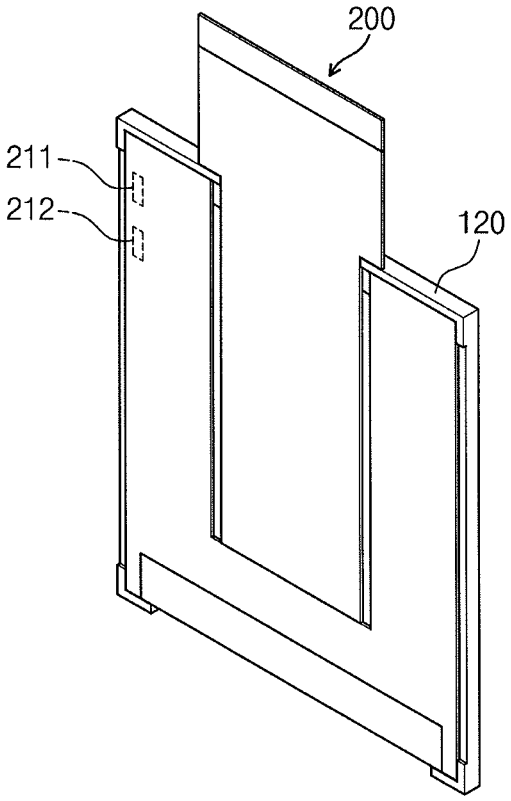
Figure 2C:
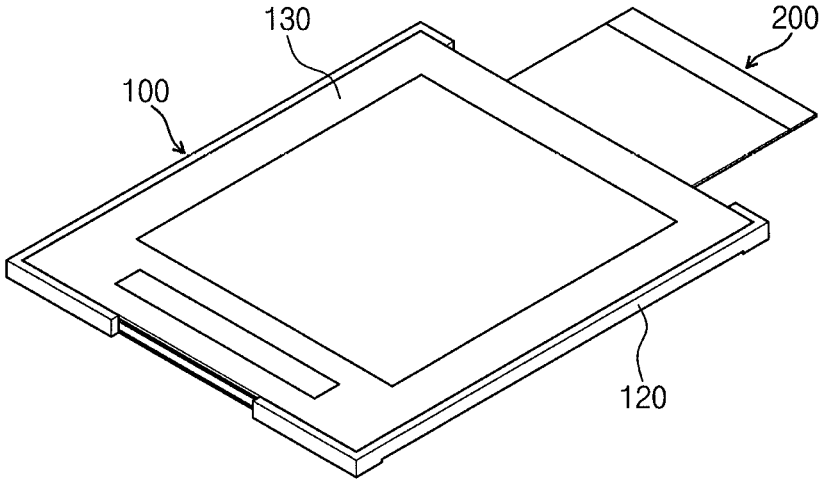

FIGS. 2A to 2C are perspective views illustrating a printed circuit board that is coupled to the module frame of FIG. 1A.

Referring to FIGS. 2A to 2C, a Printed Circuit Board (PCB) 200 may be coupled to the rear surface of the module frame 120. The PCB 200 may include a first pad 211 connected to the first contact pin 121 of the module frame 120, and a second pad 212 connected to the second contact pin 122 of the module frame 120. For close contact between the first and second contact pins 121 and 122 of the module frame 120 and the first and second pads 211 and 212 of the PCB 200, the first and second contact pins 121 and 122 may be formed to protrude from the module frame 120 to the outside, e.g., toward the outside of the display device. In another exemplary embodiment, the first and second contact pins 121 and 122 of the module frame 120 may be formed as a variable contact pin including a spring of which a height is controlled when contacting the first and second pads 211 and 212 of the PCB 200.

The first and second contact pins 121 and 122 of the module frame 120 may be disposed at all suitable positions among at least one of the upper side, the lower side, the left side, and the right side of the module frame 120. The first and second pads 211 and 212 of the PCB 200 may be disposed at positions corresponding to the first and second contact pins 121 and 122, respectively, of the module frame 120.

The PCB 200 may be formed as a hard board type of PCB, or formed as a Flexible PCB (FPCB).

Referring to FIG. 2C, the display device 100 may include a display panel 130 that is received in the module frame 120. The PCB 200 may be coupled to a lower portion of the module frame 120. The module frame 120 and the PCB 200 may be coupled by an adhesive tape (not shown). In another exemplary embodiment, the module frame 120 may include a plurality of latches and a plurality of through holes formed in the PCB 200. The latches may be respectively coupled via the through holes corresponding to them, and thus the module frame 120 may be coupled to the PCB 200. When the latches are respectively coupled via the through holes corresponding to them, a circuit block included in the PCB 200 operates. When the latches are not coupled to the through holes, the circuit block included in the PCB 200 may not operate.

Figure 3:
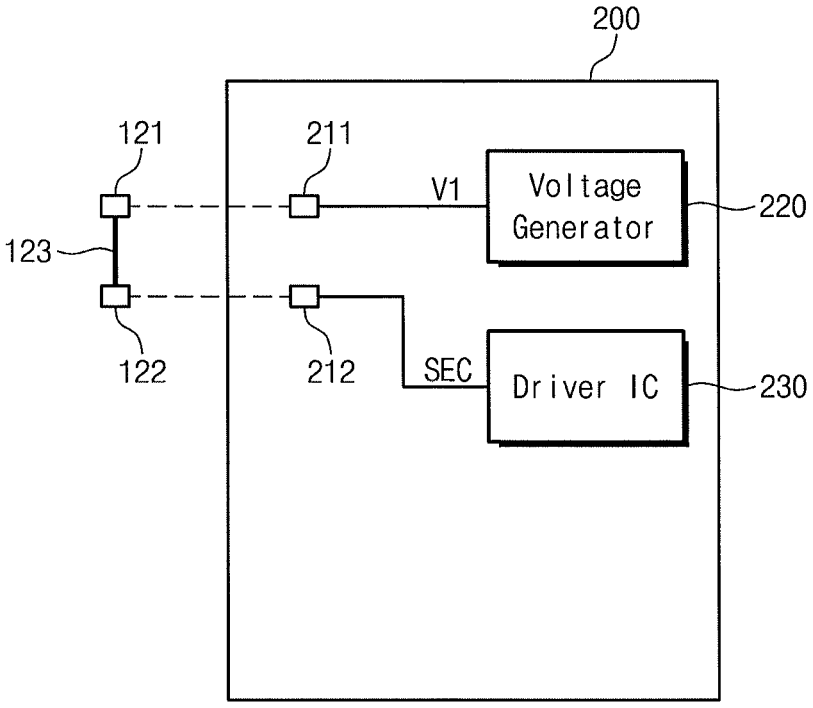
FIG. 3 illustrates a view of an exemplary embodiment of a driving Integrated Circuit (IC) that is mounted on the PCB of FIGS. 2A to 2C.

FIG. 3 is a view illustrating an embodiment of a driver Integrated Circuit (IC) that is mounted on the PCB of FIGS. 2A to 2C.

Referring to FIG. 3, the PCB 200 may include a first pad 211, a second pad 212, a voltage generator 220, and a driver IC 230. The PCB 200 may further include other circuit blocks that may be used for and/or may be necessary for operation of the display panel 130, in addition to the voltage generator 220 and the driver IC 230.

The voltage generator 220 may be connected to the first pad 211, and the driver IC 230 may be connected to the second pad 212. The voltage generator 220 may generate a first voltage V1 and may output the first voltage V1 to the first pad 211. The driver IC 230 may operate in response to a security signal SEC inputted from the second pad 212. For example, the driver IC 230 may operate when the security signal SEC has a normal state, but when the security signal SEC has a security state, the driver IC 230 may maintain a non-operation state.

As described above, when the PCB 200 is coupled to the module frame 120, the first and second pads 211 and 212 of the PCB 200 may contact the first and second contact pins 121 and 122 of the module frame 120, respectively. Therefore, the first voltage V1 generated by the voltage generator 220 may be inputted to the driver IC 230 as the security signal SEC through the first pad 211, the first contact pin 121, the electric interconnection 123, the second contact pin 122, and the second pad 212. Accordingly, when the security signal SEC has the normal state, e.g., when the security signal SEC corresponds to a first voltage V1 level, the driver IC 230 may perform an operation for driving the display panel 130. When the PCB 200 is not coupled to the module frame 120 or the PCB 200 and the module frame 120 that are in a coupled state are separated from each other, the security signal SEC inputted through the second pad 212 may be floated. In this way, when the security signal SEC has the security state, e.g., when in a floating state, the driver IC 230 may maintain the non-operation state. For example, the driver IC 230 may maintain the non-operation state when the security signal SEC does not have the level of the first voltage.

The module frame 120 and the PCB 200 may be coupled and may thereby be produced as a complete product. When the module frame 120 and the PCB 200 are disassembled in an abnormal scheme, the driver IC 230 may be configured to not operate. Accordingly, the risks of technology leakages by, e.g., a hacker or rival companies, may be minimized in the display device.

Figure 4:
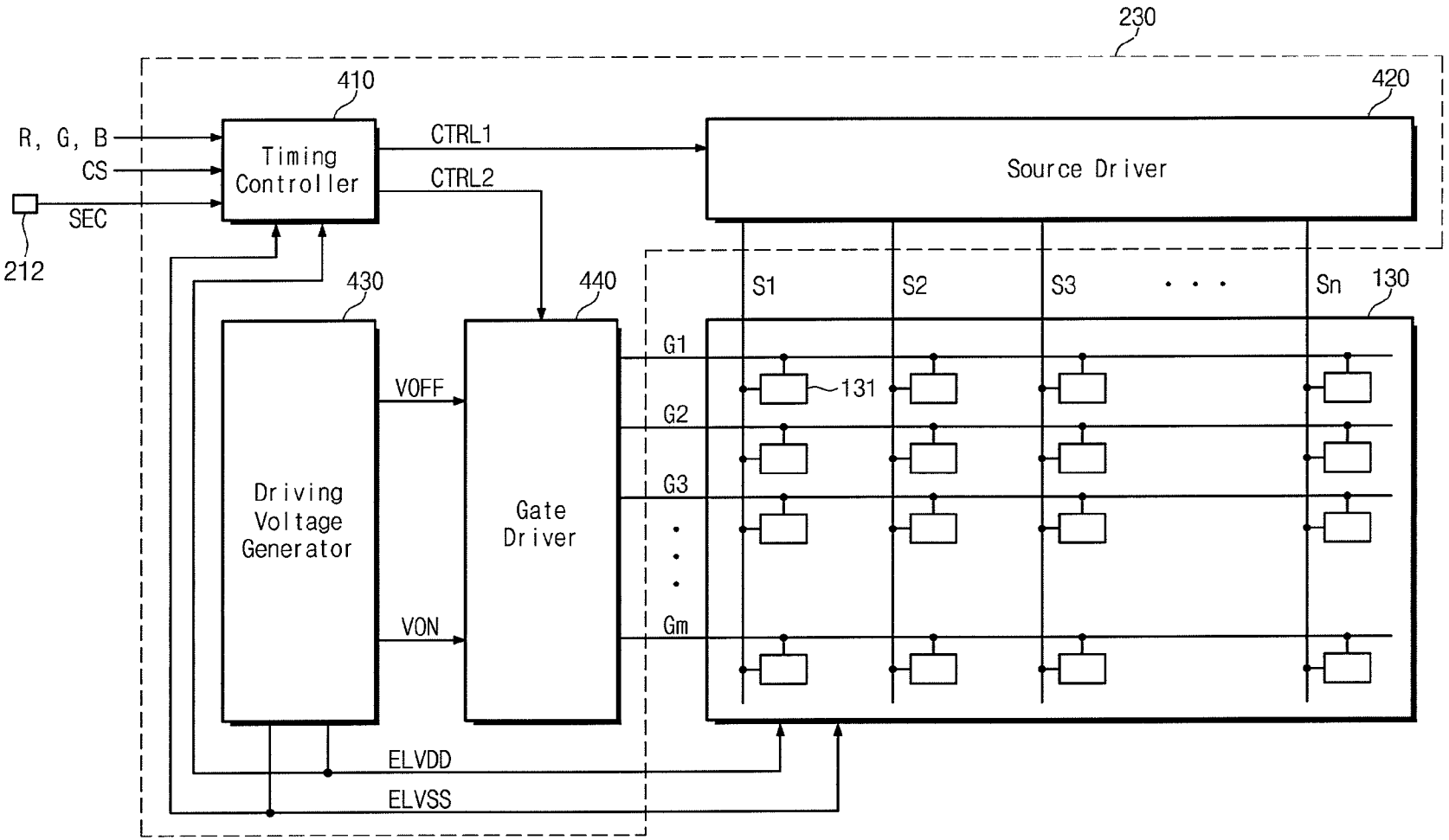
FIG. 4 illustrates a block diagram of a configuration of the driver IC of FIG. 3 and a configuration of a display panel in FIG. 2C.

FIG. 4 is a block diagram illustrating a configuration of the driver IC of FIG. 3 and a configuration of the display panel of FIG. 2C.

Referring to FIG. 4, the display panel 130 may include a plurality of gate lines, a plurality of source lines that intersect, e.g., perpendicularly intersect, the gate lines, and a plurality of pixels 131 that are respectively formed at the intersection points of the gate lines and source line, whereas the pixels 131 may be arranged in a matrix structure in the display panel 130.

The driver IC 230 may include a timing controller 410, a source driver 420, an internal voltage generator 430, and a gate driver 440. The timing controller 410, source driver 420, internal voltage generator 430 and gate driver 440 of the driver IC 230 may be included in one chip, or may be respectively included in a plurality of chips and mounted on the PCB 200.

The timing controller 410 may receive, e.g., video data signals RGB and control signals CS from an external graphic source. On the basis of the control signals CS, the timing controller 410 may output first control signals CTRL1, which may be used for and/or may be necessary for, driving the source driver 420, and may output second control signals CTRL2, which may be used for and/or may be necessary for, driving the gate driver 440. The timing controller 410 may control operation/non-operation of the display panel 130 in response to the security signal SEC, which may be received through the second contact pad 212. For example, when the security signal SEC has the normal state, the timing controller 410 may perform control for the display panel 130 to be driven. When the security signal SEC has the security state, the timing controller 410 may perform control for the display panel 130 not to be driven.

The source driver 420 may receive the first control signal CTRL1 from the timing controller 410, and may generate source driving signals S1 to Sn for driving the source lines of the display panel 130.

The gate driver 440 may receive the second control signal CTRL2 from the timing controller 410, and may generate gate driving signals G1 to Gm for scanning, e.g., sequentially scanning, the gate lines of the display panel 130.

The internal voltage generator 430 may generate voltages VOFF and VON for driving the gate driver 440, and first and second power source voltages ELVDD and ELVSS for driving the display panel 130. In an exemplary embodiment, the first and second power source voltages ELVDD and ELVSS may be supplied to the timing controller 410.

Figure 5:
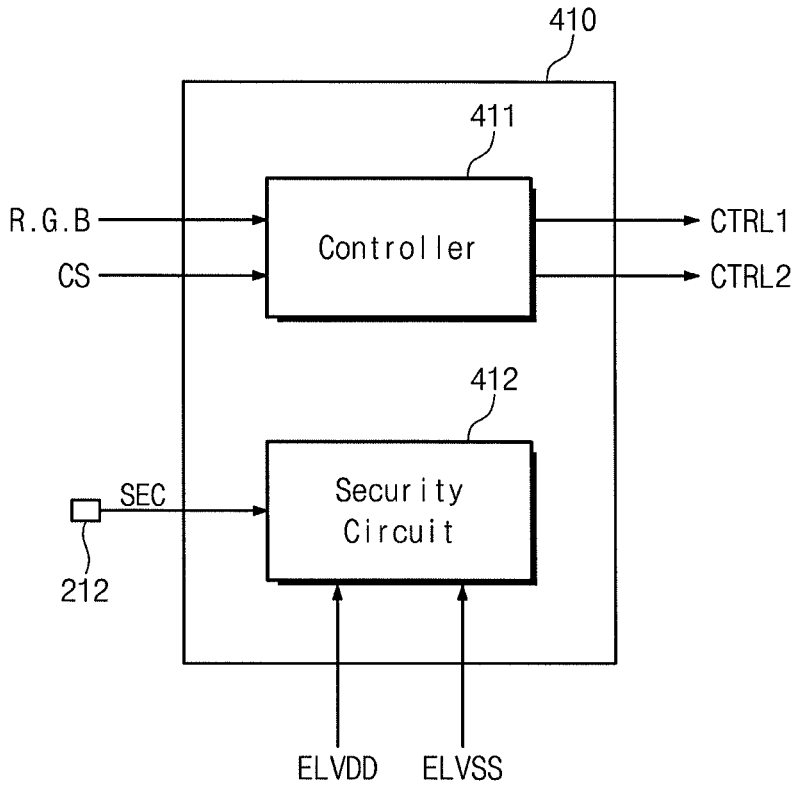
FIG. 5 illustrates a block diagram of a configuration of an exemplary timing controller in FIG. 4.

FIG. 5 is a block diagram illustrating a configuration of the timing controller 410 in FIG. 4.

Referring to FIG. 5, the timing controller 410 may include a controller 411 and a security circuit 412. The controller 411 may receive, e.g., the video data signals RGB and the control signals CS from the external graphic source, and may output the first control signals CTRL1, which may be used for and/or may be necessary for, driving the source driver 420 of FIG. 4, and the second control signals CTRL2, which may be used for and/or may be necessary for, driving the gate driver 440 of FIG. 4.

The security circuit 412 may receive the security signal SEC from the second pad 212, and may receive the first and second power source voltages ELVDD and ELVSS from the internal voltage generator 430 of FIG. 4. The security circuit 412 may operate when the security signal SEC inputted through the second pad 212 has the normal state, e.g., when the security signal SEC corresponds to the first voltage V1. When the security signal SEC inputted through the second pad 212 has the security state, e.g., when in a floating state, the security circuit 412 may not operate.

In an exemplary embodiment, the security circuit 412 may be included in the timing controller 410. However, embodiments are not limited thereto, e.g., the security circuit 412 may be included in the internal voltage generator 430, the source driver 420, or the gate driver 440 that is illustrated in FIG. 4.

Figure 6:
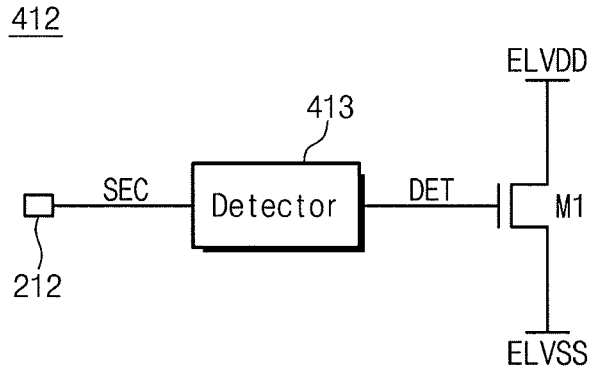
FIG. 6 illustrates a circuit diagram of an exemplary embodiment of a security circuit in FIG. 5.

FIG. 6 is a circuit diagram illustrating an embodiment of the security circuit 412 in FIG. 5.

Referring to FIG. 6, the security circuit 412 may include a detector 413 and an NMOS transistor M1. The detector 413 may receive the security signal SEC from the second pad 212, and may detect the level of the security signal SEC. The NMOS transistor M1 may be connected between the first and second power source voltages ELVDD and ELVSS, and may have a gate connected to a detection signal DET from the detector 413. When the security signal SEC inputted from the second pad 212 is higher than a certain voltage level, e.g., when the security signal SEC corresponds to the first voltage V1, the detector 413 may output the detection signal DET having a low level. Therefore, the NMOS transistor M1 may be turned off, and thus a current path may not be formed between the first and second power source voltages ELVDD and ELVSS. When the security signal SEC inputted from the second pad 212 is lower than the certain voltage level or is in the floating state, the detector 413 may output the detection signal DET having a high level. At this point, the NMOS transistor M1 may be turned on, and thus a current path may be formed between the first and second power source voltages ELVDD and ELVSS. The first and second power source voltages ELVDD and ELVSS generated by the internal voltage generator 430 of FIG. 4 may be shorted, and thus, a current may not flow to the display panel 130. Therefore, the display panel 130 may be in a non-operation state.

Figure 7:
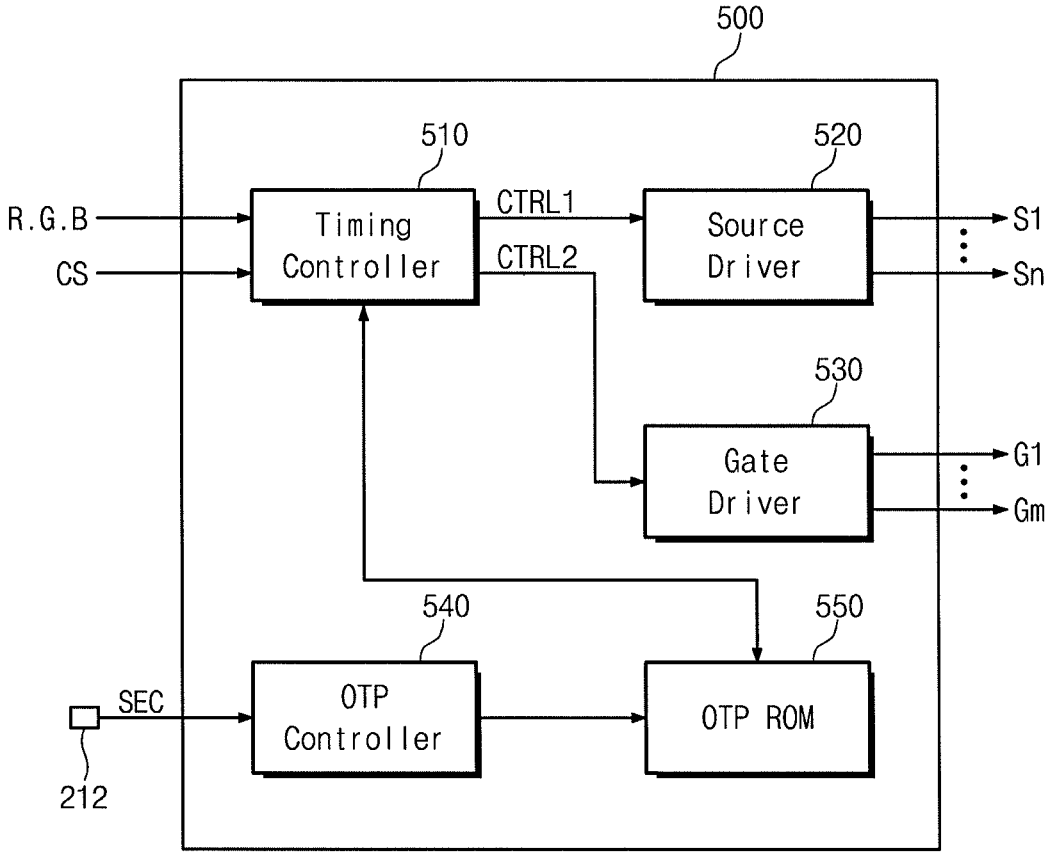
FIG. 7 illustrates a block diagram of an exemplary embodiment of a driver IC in FIG. 3.

FIG. 7 is a block diagram illustrating another embodiment of the driver IC in FIG. 3.

Referring to FIG. 7, a driver IC 500, according to another exemplary embodiment, includes a timing controller 510, a source driver 520, a gate driver 530, a One-Time Programmable (OTP) controller 540, and an OTP memory 550.

The timing controller 510 may receive, e.g., video data signals RGB and control signals CS from an external graphic source. The timing controller 510 may output first control signals CTRL1, which may be used for and/or may be necessary for, driving the source driver 520 and second control signals CTRL2, which may be used for and/or may be necessary for, driving the gate driver 530, on the basis of the received video data signals RGB and control signals CS. The source driver 520 may receive the first control signal CTRL1 from the timing controller 410, and may output source driving signals S1 to Sn, and the gate driver 440 may output gate driving signals G1 to Gm.

The OTP memory 550 may be configured as an OTP Read Only Memory (OTP ROM), and may store security setting information. The OTP ROM may be one that is programmed only once. Therefore, information stored in the OTP memory 550 may not be changed. The OTP controller 540 may be electrically connected to the second pad 212 of FIG. 3, and may store the security setting information in the OTP memory 550 in response to, e.g., a security signal SEC inputted through the second pad 212.

When the security signal SEC inputted through the second pad 212 is higher than a certain voltage level, e.g., when having a first voltage V1 level, the OTP controller 540 may store security setting information corresponding to a normal mode in the OTP memory 550. When the security signal SEC inputted through the second pad 212 is lower than the certain voltage level, e.g., when in a floating state, the OTP controller 540 may store security setting information corresponding to a security mode in the OTP memory 550.

The timing controller 510 may read the security setting information stored in the OTP memory 550 upon power-up or periodically. When the security setting information read from the OTP memory 550 has a normal mode, the timing controller 510 may operate in the normal mode. When the security setting information read from the OTP memory 550 has the security mode, the timing controller 510 may stop an operation and may not generate the first control signals CTRL1 and the second control signals CTRL2. Therefore, the display device may be putted in a non-operation state.

As described above, the display device having the security function may be manufactured as a single product. Also, the display device may be used as the display devices of electronic devices such as smart phones, MP3 players, digital cameras, mobile Internet devices, navigation devices, notebook computers, televisions and portable game machines. When an electronic device applying the display device, according to the exemplary embodiments, is disassembled by a hacker or a rival company, the display device may maintain a non-operation state, and thus technology leakage of the display device may be minimized and/or prevented.

According to the exemplary embodiments, a security function for the internal circuit of the display device can be enhanced.

By way of summation and review, an exemplary type of display device is Liquid Crystal Display (LCD) devices, which may be light and thin, and consume a low power. The LCD devices do not have self-emitting characteristic, and may include backlights. To supplement the limitations of the LCD devices, organic Electro Luminescence (EL) display devices with self-emitting characteristic have been proposed. The organic EL display devices may, e.g., electrically excite a fluorescent organic compound to emit light, and thus do not require a separate light source. The organic EL display devices may be driven at a low voltage and may be thin. The organic EL display devices are recognized as next generation display devices that may be applied to most electronic products such as mobile terminals and camcorders.

Embodiments, e.g., the exemplary embodiments discussed above, relate to a display device and to a display device having a security function. For example, embodiments may provide a display device that has a security function for an internal circuit.

The above-disclosed subject matter is to be considered illustrative and not restrictive, and the appended claims are intended to cover all such modifications, enhancements, and other embodiments, which fall within the true spirit and scope of the inventive concept. Thus, to the maximum extent allowed by law, the embodiments are to be determined by the broadest permissible interpretation of the following claims and their equivalents, and shall not be restricted or limited by the foregoing detailed description.

What is claimed is:

1. A display device, comprising:

a display panel;

a module frame including first and second contact pins and having an opening that the display panel is disposed therein; and a Printed Circuit Board (PCB) including first and second pads connectable with the first and second contact pins of the module frame, respectively, in a contacting state and disconnectable therewith in a non-contacting state;

the first and second contact pins being electrically connected to each other, and the PCB including a circuit block, the circuit block being in a non-operational state when the first and second pads are in the non-contacting state with the first and second contact pins of the module frame, respectively, wherein the circuit block of the PCB includes a driver Integrated Circuit (IC) that includes a driving voltage generator that generates first and second power source voltages for driving the display panel, and a timing controller that generates a plurality of control signals for driving the display panel, the timing controller being electrically connected to the second pad, and the timing controller being configured to short the first and second power source voltages in response to the security signal inputted through the second pad.

2. The display device of claim 1, wherein the circuit block of the PCB drives the display panel when the first and second pads are in the contacting state with the first and second contact pins of the module frame, respectively.

3. The display device of claim 1, wherein the circuit block of the PCB includes a voltage generator electrically connected to the first pad and generating a first voltage.

4. The display device of claim 1, wherein:

the driver IC is configured to control the display panel such that the display panel is driven when the security signal inputted through the second pad has a level of the first voltage, and the driver IC is configured to control the display panel such that the display panel is not driven when the security signal inputted through the second pad does not have the level of the first voltage.

5. The display device of claim 4, wherein the driver IC includes:

a driving voltage generator that generates first and second power source voltages for driving the display panel, and a security circuit electrically connected to the second pad, the security circuit being configured to short the first and second power source voltages in response to the security signal inputted through the second pad.

6. The display device of claim 5, wherein the security circuit includes:

a detector that detects a voltage level of the security signal and that outputs a detection signal, and a transistor connected between the first and second power source voltages, the transistor having a gate connected to the detection signal.

7. The display device of claim 4, wherein the driver IC includes:

a timing controller that generates first and second control signals for driving the display panel, a source driver that drives a plurality of source lines of the display panel in response to the first control signal, a gate driver that drives a plurality of gate lines of the display panel in response to the second control signal, a memory that stores security setting information, and a security controller electrically connected to the second pad, the security controller storing the security setting information in the memory in response to the security signal inputted through the second pad, and the timing controller being in a non-operational state when the security setting information stored in the memory has a first value.

8. The display device of claim 7, wherein the memory is a One-Time Programmable Read Only Memory (OTP ROM).

9. The display device of claim 8, wherein:

when the security signal inputted through the second pad does not have the level of the first voltage, the security controller stores security setting information corresponding to a security mode in the memory, and when the security signal inputted through the second pad has the level of the first voltage, the security controller stores security setting information corresponding to a normal mode in the memory.

10. The display device of claim 1, wherein the PCB is a Flexible PCB (FPCB).

11. The display device of claim 1, wherein the display panel is an Active Matrix Organic Light Emitting Diode (AMOLED) panel.

* * * * *